US007007862B2

(12) United States Patent
Chiang et al.

(10) Patent No.: US 7,007,862 B2
(45) Date of Patent: Mar. 7, 2006

(54) RINSE RELEASE DISPENSING DEVICE

(75) Inventors: Ken Chiang, Oakland, CA (US); Michael J. Petrin, Oakland, CA (US); Timothy M. Soto, Oakland, CA (US); Frank M. Knafelc, Oakland, CA (US)

(73) Assignee: The Clorox Co., Oakland, CA (US)

( * ) Notice: Subject to any disclaimer, the term of this patent is extended or adjusted under 35 U.S.C. 154(b) by 280 days.

(21) Appl. No.: 10/704,495

(22) Filed: Nov. 7, 2003

(65) Prior Publication Data

US 2005/0109860 A1 May 26, 2005

(51) Int. Cl.
*A24F 25/00* (2006.01)
*A61L 9/04* (2006.01)

(52) U.S. Cl. ..... 239/34; 239/47; 239/51; 239/51.5; 239/57; 239/6

(58) Field of Classification Search ..... 239/34, 239/47, 51, 57, 6, 7, 10, 51.5; 134/193
See application file for complete search history.

(56) References Cited

U.S. PATENT DOCUMENTS

| | | | | |
|---|---|---|---|---|
| 2,534,014 A | | 12/1950 | Gayring et al. | |
| 2,956,709 A | | 10/1960 | Nison et al. | 222/52 |
| 2,991,911 A | | 7/1961 | Spain | |
| 3,108,722 A | | 10/1963 | Torongo, Jr. et al. | 222/463 |
| 3,180,538 A | | 4/1965 | Brown et al. | 222/500 |
| 3,233,794 A | | 2/1966 | Sisler | |
| 3,258,792 A | * | 7/1966 | Rickel | 8/158 |
| 3,330,135 A | | 7/1967 | Douglas | |
| 3,481,163 A | | 12/1969 | Bochan et al. | |
| 3,596,480 A | | 8/1971 | Douglas | 68/17 A |
| 3,620,054 A | | 11/1971 | Drews et al. | 68/17 A |
| 3,670,530 A | | 6/1972 | Filipak | 68/17 A |
| 3,699,785 A | | 10/1972 | Waugh | 68/17 A |
| 3,736,773 A | | 6/1973 | Waugh | 68/17 A |
| 3,757,544 A | * | 9/1973 | Olthuis | 68/17 A |
| 3,888,391 A | | 6/1975 | Merz | 222/52 |
| 3,921,421 A | * | 11/1975 | Kretchman et al. | 68/17 R |
| 3,974,667 A | | 8/1976 | Gakhar | 68/17 R |
| 4,026,131 A | | 5/1977 | Dugger et al. | 68/17 A |
| 4,118,957 A | | 10/1978 | Marcussen | 68/17 A |
| 4,154,069 A | | 5/1979 | Lipfert et al. | 68/17 A |
| 4,186,573 A | | 2/1980 | Brenner et al. | 68/12 R |
| 4,186,574 A | | 2/1980 | Sundstrom | 68/17 A |
| T993,001 I4 | | 4/1980 | McCarthy | 68/17 R |
| 4,240,277 A | | 12/1980 | Manthei | 68/17 A |
| 4,260,054 A | | 4/1981 | Bory et al. | 206/0.5 |
| 4,379,515 A | | 4/1983 | Towsend | 222/52 |
| 4,420,951 A | | 12/1983 | Clearman et al. | 68/17 R |
| 4,478,059 A | | 10/1984 | Yates | 68/17 A |
| 4,882,917 A | | 11/1989 | Mizusawa et al. | 68/17 A |
| 4,942,973 A | | 7/1990 | Bowie | 220/201 |
| 4,982,467 A | | 1/1991 | Mizusawa et al. | 8/158 |

(Continued)

*Primary Examiner*—Davis Hwu
(74) *Attorney, Agent, or Firm*—David Peterson; Monica Winghart; Joel Hayashida

(57) ABSTRACT

A lightweight, free-body and buoyant dispenser that is centrifugally actuated for releasing a laundry product following the spin cycle includes a housing that has one or more covered apertures one of which is exposed during the spin cycle. The laundry product, which is a liquid, solid, gel powder, or mixture thereof, however, does not exit the dispenser until the spinning has subsided. Disc-shaped dispensers having two apertures that are covered by biased-doors are especially suited for delivering laundry agents for post-spin cycle treatment.

24 Claims, 4 Drawing Sheets

U.S. PATENT DOCUMENTS

| | | | | |
|---|---|---|---|---|
| 5,176,275 | A | 1/1993 | Bowie | 220/201 |
| 5,226,301 | A | 7/1993 | Rizzetto et al. | 68/17 R |
| 5,267,671 | A | 12/1993 | Baginski et al. | 222/154 |
| 5,314,098 | A | 5/1994 | Milenkevich | 222/463 |
| 5,355,541 | A | 10/1994 | Rutter et al. | 8/158 |
| 5,388,298 | A | 2/1995 | Rutter et al. | 8/158 |
| 5,531,081 | A | 7/1996 | Savkar et al. | 68/17 A |
| 5,768,918 | A | 6/1998 | McKibben | 68/17 R |
| 6,032,495 | A | 3/2000 | Leu | 68/17 R |
| 6,301,733 | B1 | 10/2001 | Dawson et al. | 8/158 |
| 6,301,734 | B1 | 10/2001 | Dunsbergen et al. | 8/158 |
| 2003/0000972 | A1 | 1/2003 | Hague et al. | 222/463 |
| 2003/0052138 | A1 | 3/2003 | Smith | 222/463 |

* cited by examiner

RINSE RELEASE DISPENSING DEVICE

FIELD OF THE INVENTION

The present invention relates to a dispenser for releasing a laundry product such as a fabric treating agent or conditioner for use in washing machines, and more particularly to a centrifugally actuated dispenser.

BACKGROUND OF THE INVENTION

Various laundry products or additives are used in washing machines to maximize cleaning, fabric protection and the like. However, in order for many of these additives to be effective, it is often necessary to segregate the different additives when more than one is employed as the presence of one additive may adversely affect the others. Similarly, some additives are effective only at certain stages of the wash cycle. For instance, fabric softeners or other fabric treating agents must be added to the laundry in the washing machine during the final rinse portion of the wash cycle. If the fabric softener is added before, most of the softener is simply wasted. Thus, a consumer using an automatic washing machine will typically add detergent to the basket of the washing machine along with the soiled clothing and, subsequently, wait until the final rinse portion before adding fabric softener.

To make using fabric softeners more convenient, dispensers have been developed which release a liquid additive to the clothe basket of a washing machine at the appropriate phase after the wash cycle. Examples of these are found in U.S. Pat. No. 2,991,911 to Spain, U.S. Pat. No. 2,534,014 to Gayring et al., and U.S. Pat. No. 3,233,794 to Sisler. Unfortunately, these prior art devices exhibit a number of deficiencies. One shortcoming is that they are rather complex and expensive. They further require attachment and some integration into the workings of the washing machine with which they are used, and therefore materially add to cost. These devices typically may not be merely added to an existing washing machine but must be built into the machine at the factory, thus making them virtually useless for existing washing machines that have been sold without such automatic dispenser capability.

Another approach to improving consumer convenience is the multi-use approach wherein two or more laundry additives are included on a single delivery substrate. The multi-use approach contemplates depositing two or more additives targeted at different phases of a laundry cycle, e.g. detergent plus a fabric softener, upon or within a delivery substrate. The substrate is added to the washer at the start of the laundry cycle, and is designed to dispense the additive at the stage of the wash cycle where the additive is most effective.

There are several drawbacks associated with multi-use compositions of the art. Typically, delivery of each additive does not occur exactly at the stage of the wash cycle where its use is most efficient. Multi-use packages are often inefficient owing to their fixed proportions of the various additives. The consumer thus cannot vary the amount of a particular additive without altering the amount of the remaining additives. In many cases, delivery of a particular additive does not occur, or incompletely occurs, when intended. This severely reduces performance of the additive. Some additives can interact with their co-additives, also severely reducing their performance. Most multi-use additives include the additive, e.g. fabric softener, with the detergent composition, and such detergents usually hamper the performance of such softeners. The detergent/softener compositions are thus relatively easy to use, but do not work well.

Another approach to obtaining the convenience of multi-use compositions with the effectiveness and flexibility of single-use additives is to provide a means for dispensing the additive at the desired point(s) in the cycle. Typically such a dispenser is a mechanical device built into the washing machine, and has a limited capability for dispensing additives. Many of these dispensers are suited to dispense only liquid additives and usually are made by the appliance manufacturers to fit only certain models of washing machines that they also manufactured. A number of patent references describe dispensers that use centrifugal force developed by a washing machine during a spin phase to effect release of an additive. The centrifugal dispensers of the art appear to fall into two categories: (a) passive dispensers with no moving parts which rely entirely on centrifugal force to release the additive; and (b) active dispensers which utilize centrifugal force to effect a change in configuration of the dispenser, causing the release of the additive.

Generally, the prior art dispensers of the first type are suited to dispense only liquid additives, which are effective only if delivered in the rinse. The second class of prior art dispensers are often complex, and/or are limited in their application to a small number of washing machine agitators. The liquid additives suffer the disadvantage of being inconvenient, and often messy to use, while the mechanical dispensers necessary to dispense the liquid additive generally must be provided by the manufacturer with the washing machine, and cannot be retrofitted.

The first category of prior art dispensers describe, in general, a two-chamber dispenser that is mounted on top of an agitator. An inner chamber has outwardly sloping walls and is initially filled with the additive. Coakial with and having larger diameter than this inner chamber is an outer chamber with straight walls and often a circumferential channel. At the bottom of the second chamber are one or more apertures that allow the additive to drain into the tub of the washing machine. With this type of dispenser, a liquid additive to the inner chamber and during the spin phase, centrifugal force causes the additive to flow out over the sloping walls and into the second chamber, where it continues to flow under the influence of centrifugal force into the circumferential channel. When the spin phase ends, the additive flows by gravity out or the apertures at the bottom of the second chamber and into the tub as it is filling with rinse water. Dispensers of this type are disclosed, for example, by U.S. Pat. No. 4,240,277 to Manthei, U.S. Pat. No. 4,186,574 to Sundstrom, U.S. Pat. No. 4,118,957 to Marcussen, U.S. Pat. No. 3,736,773 and U.S. Pat. No. 3,699,785 both to Waugh, U.S. Pat. No. 3,620,054 to Drews et al, U.S. Pat. No. 3,596,480 and U.S. Pat. No. 3,330,135 both to Douglas, U.S. Pat. No. 3,481,163 to Bochan et al., and U.S. Pat. No. 4,478,059 Yates.

Other dispensers which rely on centrifugal force to release an additive, but which are not attached to the agitator include free body dispensers having a balloon-like additive reservoir that releases additive under pressure generated by spin phase centrifugal forces, especially if the reservoir is sandwiched between a laundry load and the sidewall of the machine. See for, example, U.S. Pat. No. 4,379,515 to Townsend. U.S. Pat. No. 4,186,573 to Brenner et al. describes a centrifugally actuated two-chamber dispenser which hangs on the rim of the wash tub; operation of this device is similar to the agitator-mounted two-chamber dispensers, i.e., centrifugal fill of an outer chamber and gravity flow after the spin ceases.

There are numerous prior art centrifugal force operated dispensers that effect a mechanical change in the dispenser and that indirectly cause the dispensing of the additive. U.S. Pat. No. 4,420,951 to Clearman et al. describes a dispenser apparatus that is mounted on an agitator that includes a water pump and a nozzle. Under centrifugal force created by the spin, the nozzle is redirected to aim a flow of water into a portion of the dispenser containing the additives. U.S. Pat. No. 4,026,131 to Dugger describes a pouch containing an additive and constructed such that a seal on the pouch is broken under the centrifugal force of the spin, freeing the additive. U.S. Pat. No. 3,757,544 to Olthuis describes an agitator-mounted dispenser that is held above the water level during the wash. During the spin phase the centrifugal force releases a catch on the dispenser causing it to fall below the rinse water level. T993,001 (U.S. Defensive Publication) to McCarthy describes a spin actuated dispenser having a mass attached to a valve. U.S. Pat. No. 4,260,054 to Bory et al. discloses non-soluble sheets having partially serrated phases that rupture under spin-generated centrifugal force, releasing an additive. U.S. Pat. No. 3,888,391 to Merz discloses a dispenser that releases additive via a centrifugally actuated valve. U.S. Pat. No. 3,670,530 to Filipak shows a dispenser that may be attached to the agitator and comprises a pivotable cup that pivots from vertical to horizontal during spin, pouring out the additive.

In view of the deficiencies of the existing art, there remains a need for a simple, reliable mechanical dispenser, which can be used with a wide variety of existing commercially available washing machines, for dispensing a laundry additive into the washing machine during a selected phase of the washing cycle.

SUMMARY OF THE INVENTION

The present invention is based in part on the development of a lightweight, free-body dispenser that is centrifugally-actuated for releasing a laundry product following the spin cycle and typically in the rinse cycle which obviates the need for consumer intervention. The dispenser can use laundry products in the form of a liquid, solid, gel, powder, or mixtures thereof. Specifically, the laundry product, which is typically water soluble, is released through an opened aperture of the dispensing device and into the washing machine as it is being filled with rinse water following the spin cycle. The laundry product then comes into contact with the clothes as the product dissolves in the water.

Accordingly, in one aspect the invention is directed to a dispenser, for use in a basket of an automatic washing machine for dispersing a laundry product into the basket that includes a rotatable inner wall and an interior region, wherein the dispenser includes:

a housing defining an internal chamber adapted to receive the laundry product and having at least one aperture;

cover means for covering and sealing the at least one aperture wherein the cover means includes at least one cover that is movable between a closed position and an opened position upon activation of the cover means;

latch means for engaging the at least one cover to maintain the at least one cover in its closed position until the latch means is disengaged whereby the at least one cover moves to its opened position;

a weight assembly that is actuated by centrifugal force and that is operatively connected to the latch means, whereby the weight assembly upon actuation by the centrifugal force causes the latch means to disengage the at least one cover;

means for causing the housing to orient within the basket, when the housing is subject to a centrifugal force, so that when the weight assembly is actuated and the at least one cover moves to its opened position the laundry product remains within the internal chamber until the centrifugal force has substantially subsided or been removed, with the proviso that only one aperture becomes exposed to the environment when the housing is subject to the centrifugal force; and means for biasing the weight assembly to return the weight assembly to a neutral position when the centrifugal force has substantially subsided or been removed.

In another aspect, the invention is directed to a dispenser, for use in a basket of an automatic washing machine for dispersing a laundry product into the basket that includes a rotatable inner wall and an interior region, wherein the dispenser includes:

a housing defining an internal chamber adapted to receive the laundry product and having first and second apertures;

a first cover means for covering and sealing the first aperture, which includes a first cover that is movable between a first closed position and a first opened position upon activation of the first cover means;

a second cover means for covering the second aperture, which includes a second cover that is movable between a second closed position and a second opened position upon activation of the second cover means;

a weight assembly that is actuated by centrifugal force and thereupon activates either the first cover means or the second cover means, but not both, thereby uncovering and unsealing one of the first or second apertures;

means for causing the housing to orient within the basket, when the housing is subject to a centrifugal force, so that when either the first or second cover means is activated and either the first or second cover moves to its opened position the laundry product remains within the internal chamber until the centrifugal force has substantially subsided; and means for biasing the weight assembly to return the weight assembly to a neutral position when the centrifugal force has substantially subsided or been removed.

The dispenser is preferably buoyant and has two sealable apertures each of which can be opened by centrifugal force. An important feature of the dispensing device is that one of the apertures is opened by the centrifugal force during the spin cycle; nevertheless, the laundry product remains within the chamber of the dispensing device and is not released from the dispensing device until the spinning has substantially stopped.

DETAILED DESCRIPTION OF PREFERRED EMBODIMENTS

Figure 1:
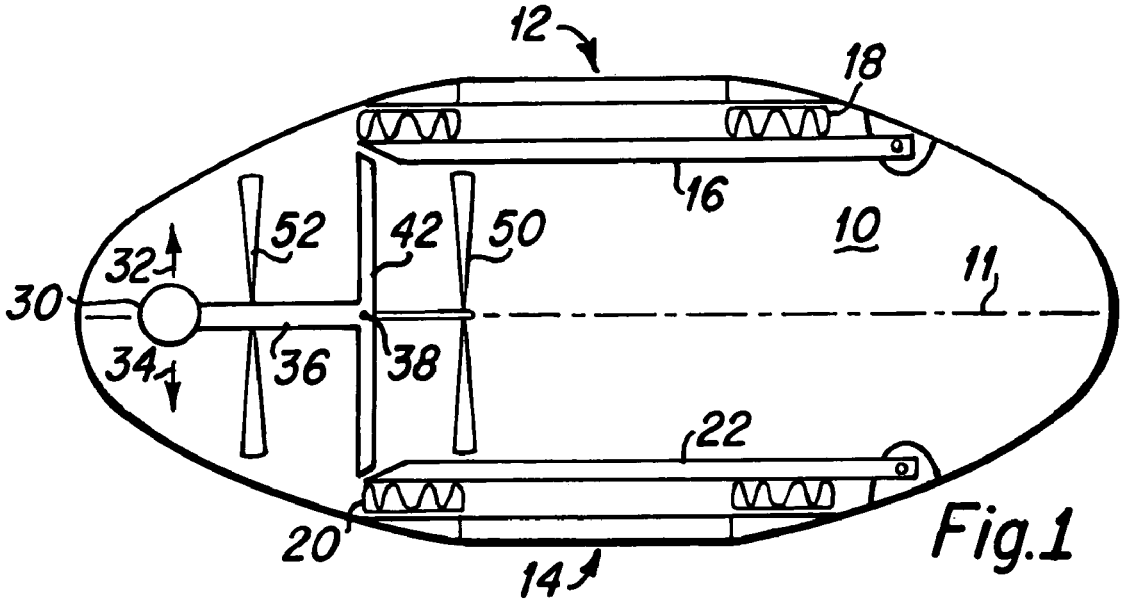
FIGS. 1 and 2 are cross-sectional elevational views a dispenser of the instant invention.
Figure 2:
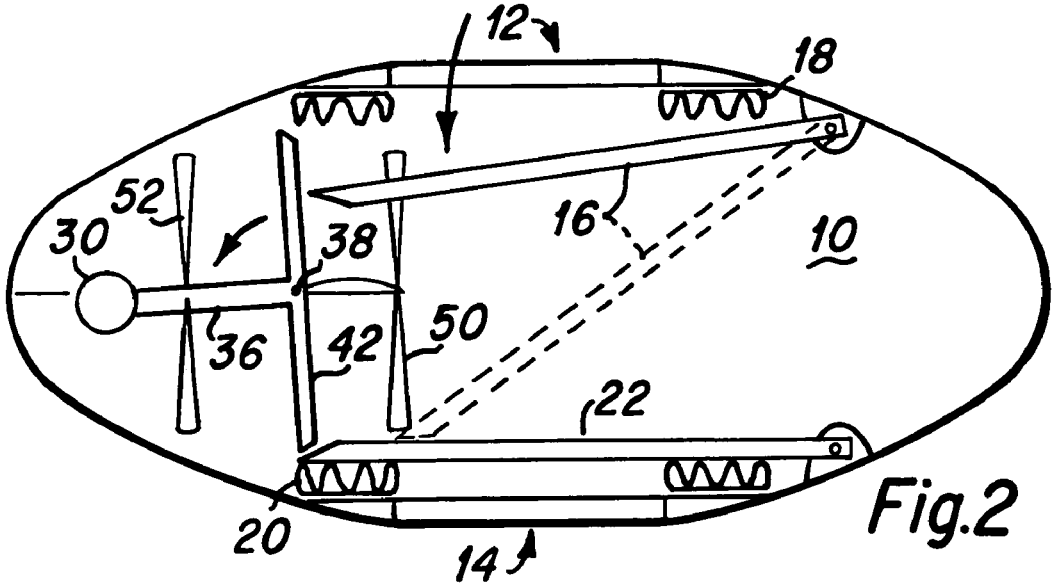

Referring to FIGS. 1 and 2, one embodiment of the dispensing device has an overall disc-shaped configuration with a round outer perimeter and relatively flat outer contours formed on opposite sides. The device is preferably constructed of a pair of shells made of light-plastic material that is buoyant in water so that the device, when filled with the intended additive, remains afloat on the surface of the water thereby avoiding entanglement with clothing during the wash cycle. In addition, the device will rest on top of the clothing after the water has drained from the basket or drum following the wash cycle. In this fashion, the dispenser does not become entangled with the articles in the basket when the spin cycle begins so that the device can assume the proper orientation against the basket wall, i.e., against the articles of clothing that are banked against along the side of the wall, during the spin cycle.

The device has an inner chamber 10 and apertures 12 and 14 that are each located at two opposite facing flat contours. The overall configuration of the device is symmetrical about the longitudinal axis 11 and the internal parts within the chamber are situated about this axis so that the device is evenly balanced. In this fashion, during the spin cycle, the device will be held by the centrifugal force against the basket of the washing machine with one of the flat surfaces of the device being pressed against the wall of the basket.

Aperture 12 is covered by hinged door 16 and aperture 14 is likewise covered by hinged door 22. Seals 18 and 20 are positioned around the perimeter of apertures 12 and 14, respectively. Alternatively, the seals can be attached to edges of the doors. The hinged doors are biased toward the center of chamber 10 and, as illustrated in FIG. 1, the doors are kept closed by latch 42 which is an elongated member having a first end that is in contact with door 16 and a second end that is in contact with door 22. The latch is connected via member 36 to a lever/weight assembly that includes weight 30. Latch 42 is pivotably attached to member 36 at pivot point 38 so that movement of weight 30 in direction 32 or 34 will cause the latch to move in either of two predetermined directions. Specifically, as illustrated in FIG. 2, when weight 30 is pulled toward direction 34, latch 42 rotates around pivot point 38 so that the first end of latch 42 becomes disengaged from door 16. The biased door swings inward immediately thereby exposing the chamber 10 to the outside environment through aperture 12. As shown in FIG. 2, the second end of the latch however remains engaged to door 22 thereby keeping it closed.

Figure 3A:
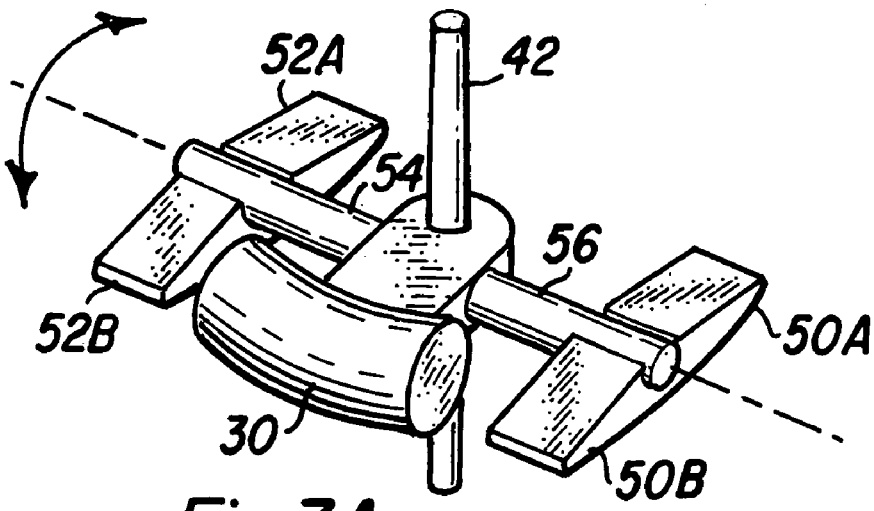
FIGS. 3A and 3B depict the lever/weight assembly and corresponding support elements, respectively, for the dispenser.
Figure 3B:
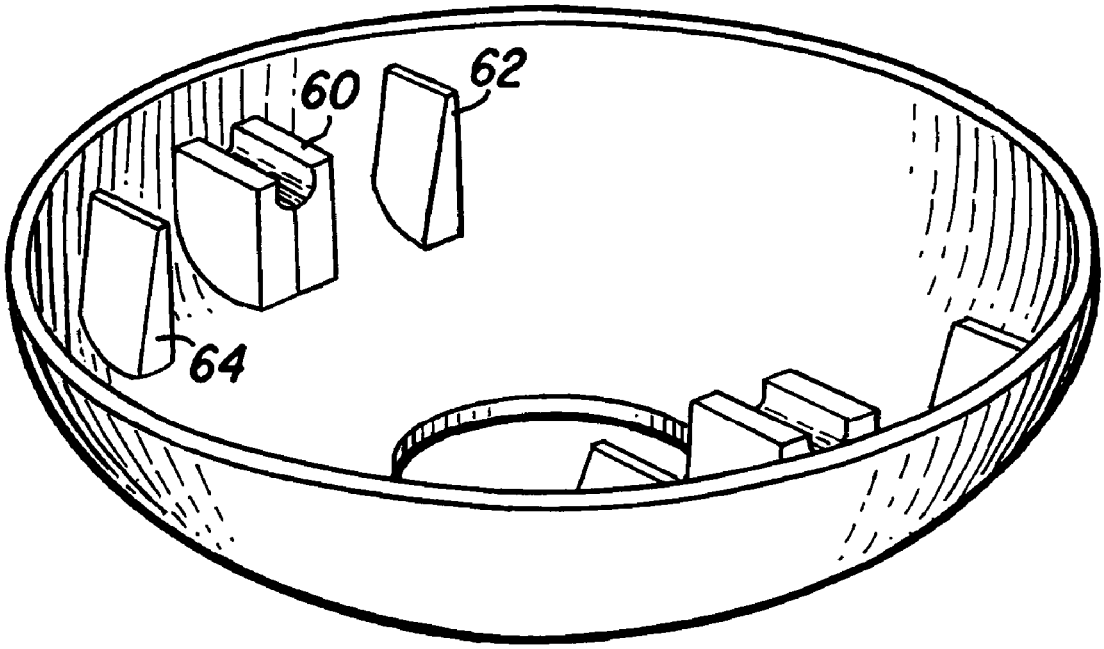

As shown in FIGS. 1 and 2, the lever/weight assembly also includes two realignment elements 50, 52 for repositioning weight 30 to its original or neutral position once the spinning has substantially stopped. Operation of the realignment elements 50, 52 is further illustrated in FIGS. 3A and 3B. As shown, each realignment element has two sets of wings 50A, 50B and 52A, 52B that are attached to rod members 56 and 54, respectively. As shown in FIG. 3B, each half of the inner shell of the dispensing device has support features for the lever/assembly that include a center support 60 for rod 54 and side supports 62 and 64 for wings 52A and 52B, respectively. Corresponding support features for rod 56 and wings 50A and 50B are shown on the other side of the shell. In addition, the other half of the shell (not shown) has matching support elements that together with those illustrated in FIG. 4, secure the lever/assembly. The rods 54, 56 (FIG. 3A) fit into their respective center supports so that the rods are free to rotate; the wings 50A, 50B and 52A, 52B rest between the tips of the side supports.

The wings are made of light weight, resilient material such as plastics, e.g., polyethylene. As shown in FIGS. 2 and 3A, when the dispenser is subject to a centrifugal force, weight 30 is pulled away from its neutral position on axis 11; this motion causes the resilient material of the wings to bend. As shown in FIG. 2, the movement of weight 30 will also cause latch 42 to shift thereby disengaging one end of the latch from door 16 that springs open. When the centrifugal force is removed, e.g., after the spin cycle terminates, the wings act as springs to return the weight 30 to its original neutral position but hinged door 16 remains open. The weight assembly can employ other biasing means to return the weight 30 to its neutral position. For instance, the weight assembly can be spring-loaded.

One of the distinguishing features of the dispenser is that even though one of its two doors opens during the spin cycle, the laundry product remains within the chamber until the spin cycle has substantially stopped and the basket is refilled with fresh water. Referring to FIG. 2, when the dispenser is subject to a centrifugal force as in the washing machine basket, the force will orient the dispenser so that one of its flat surfaces becomes substantially oriented toward the outer perimeter of the basket and the other flat surface of the device faces the center of the basket. It is understood, that articles being washed may be situated between the outer perimeter of the basket and the dispenser. In the illustration of FIG. 2, the side of the dispenser with aperture 12 would be facing the center and the side with aperture 14 would be pressed against the basket. Thus, even when door 16 swings opening, the contents inside chamber 10 do not exit the chamber because the laundry product also is subject to the centrifugal force.

To prevent the doors of the dispenser from opening prematurely before the spin cycle, the dispenser is designed so that the doors do not open under the influence of the relatively mild forces generated during the wash cycle. In other words, the agitation forces associated with the wash cycle do not move weight 30 sufficiently to permit either door 16 or 22 to open. One technique of achieving this is to use a weight 30 that is of sufficient mass.

In use, a consumer fills the chamber of the dispenser with a laundry product, e.g., rinse released product, through aperture 12 or 14, then closes the spring-loaded door with the aid of one the raised finger grip protrusions 13 or 15 on the surface of the doors 16 and 22, respectively. The loaded dispenser is ready for use and can be in placed the drum of an automatic washing machine along with the soiled clothing to be washed. The dispenser can be loaded with any desired laundry product especially products, such as fabric softeners, that are intended to interact with articles being laundered following the initial spin cycle. However, it is understood that laundry products can also include, for example, any composition added to enhance the cleanliness, sanitation or aesthetics of fabrics, and includes, but is not limited to detergents, whiteners, fabric softeners, antistatic agents, bleaches, bleach activators, anti-redeposition agents, enzymes and mixtures of the foregoing.

The dispenser is particularly suited for delivering a fabric treatment composition for imparting fabric protection benefits, including stain resistance, oil repellency, water repellency, softness, wrinkle and damage resistance, and improved hand feel. One such composition is described in U.S. patent application Ser. No. 10/338,350 filed Jan. 8, 2003 to Kaaret et al. and entitled "Fabric Treatment for Stain Release," which is incorporated herein by reference. This fabric treatment composition includes at least one zeta potential modifier and a hydrophobic agent having a melting point or glass transition temperature of less than 100° C. A fluoropolymer is preferably included. The composition once treated onto the fabric can be cured by exposing the fabric to a temperature above ambient but less than 100° C. that can be accomplished in an automatic drying machine.

The dispenser of the present invention can be used in any automatic clothes washing machines that includes a clothes-basket into which the clothes to be washed are placed. Preferred are top loading machines, which are the kind having a vertically oriented basket with a hinged, top loading door, the clothes are loosely placed in the basket around a centrally disposed agitator. Typically, the agitator tapers from a base at the bottom of the clothesbasket to a generally frustoconical end or projection spaced from the top door when in the closed or horizontal position. A plurality of agitator blades is frequently found on the sides of the agitator for disturbing the wash water and thereby removing dirt and other contaminants from the clothes.

Commonly, these automatic washing machines have control mechanisms for establishing a sequence of washing cycles. The general sequence is washing, extracting by wash water by spinning, rinsing and then extracting rinse water by spinning again. Of course, variations from this typical sequence in different machines are also possible.

After the machine is loaded with clothes, and the lid closed, the first cycle of washing begins with the slow filling of the wash basket with water. This filling takes a period of several minutes. Usually, a soap or detergent is used in the washing operation. The soap or detergent is generally placed in the wash basket over the clothes prior to the closing of the lid and the initiation of the washing cycles. The inventive dispenser, which is loaded with the desired laundry product, can be placed into the basket at this time for spin actuated.

During the wash cycle, the doors of the buoyant dispenser remain closed thereby isolating the laundry product inside the chamber from the wash liquor. When the wash cycle is complete with the wash liquor having been drained from the basket, initiation of the spin cycle causes the realignment of the dispenser device against the side of the basket as described herein.

The centrifugal force acting on the lever arm releases one of the latch ends that engage one of the spring-loaded doors. Specifically, the door that is opposite the direction of the force, in other words, the inward facing door, swings open inwardly toward the inner chamber. Although the inward facing door is now open, centrifugal force also keeps product inside the device. When the spin cycle stops, the device falls to the bottom of the basket and the laundry product dissolves in the rinse water that fills the basket and freely enters the now opened dispenser.

After the basket is filled, rinse agitation helps disperse the product throughout the rinse water. The weighted levers orients the device perpendicular to the horizontal plane of the basket such that product can more easily be rinsed out of the device. Hence, the device enables automatic release of a product into the rinse wash cycle of any automatic washing machine employing a centrifugal spin cycle without the need for user intervention or concerns about premature release of the product other cycles of the washing machine.

Figure 4:
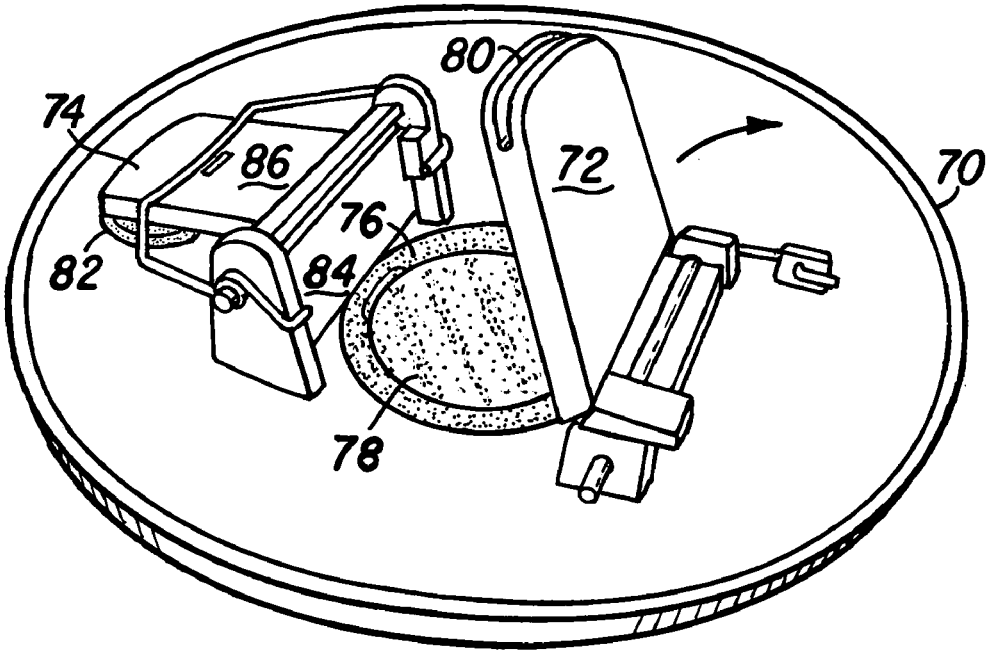
FIGS. 4 and 5 are the perspective interior views of a half portion of the dispenser with the aperture opened and closed, respectively.
Figure 5:
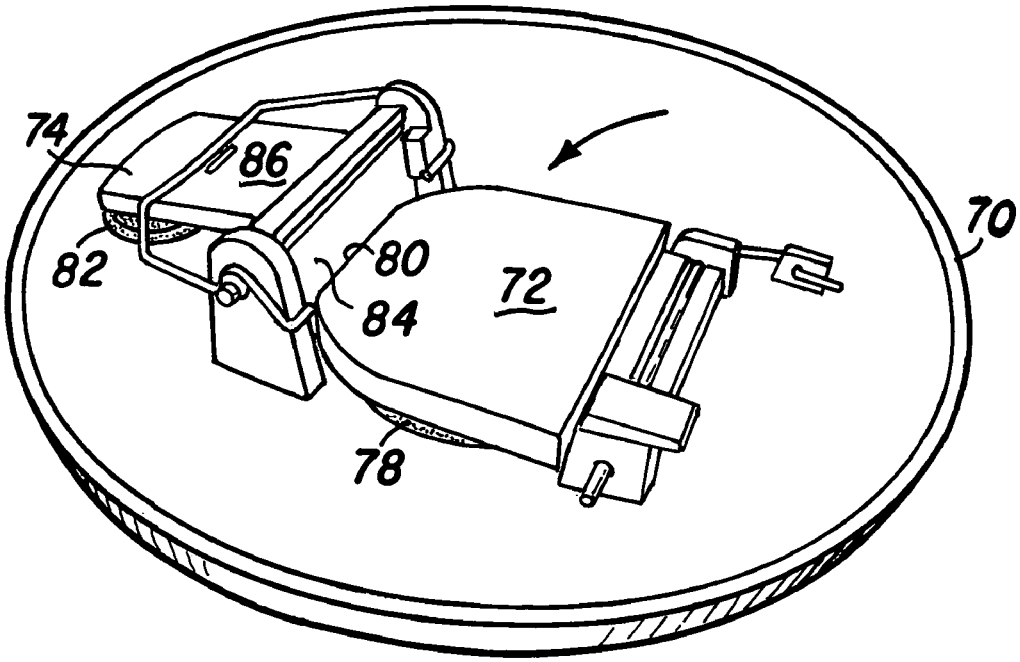

FIGS. 4 and 5 illustrate another embodiment of the dispensing device that has two hinged doors that are separately activated. As depicted, the interior of the lower half of the device, which has an overall disc-shaped configuration, has a round exterior perimeter 70 and relatively flat outer contours formed on opposite sides. A dispenser is formed when two symmetrical halves or shells are sealed to create an enclosed chamber or compartment.

As shown in FIG. 4, one shell includes an aperture 78 that has a water-resistant seal or gasket 76 surrounding its perimeter. The aperture is flanked on one side by the spring loaded hinged door 72 that is biased to open toward the interior and on the other side by a spring-loaded lever/weight assembly 74. Alternatively, the seals can be attached to the perimeter of edges of the door. The door 72 has a lip 80 at one end. The lever/weight assembly includes a lever arm 86 that supports a weight 82 at one end and a shorter extension arm 84 at the other end. The lever/weight assembly is designed so that when centrifugal force pulls the lever arm toward the center of the device, the extension arm bends away from the center. To facilitate the closing of an opened door, surface of each door facing that faces the exterior environment can also be equipped with a raised finger grip protrusion.

As shown in FIG. 5, the closed door 72 seals the aperture; this effectively creates a watertight compartment within the dispenser when both apertures are so sealed. Sealing of the aperture is accomplishing by securing the lip of the door to the extension arm of the lever/weight assembly. The door remains closed until centrifugal force activates the lever/weight assembly to bend the extension arm and thereby disengage the door that then swings open.

In constructing a dispenser by mating two half portions illustrated in FIGS. 4 and 5, it is preferred that the halves are arranged so that weights are the same side of the device. This provides for better weight distribution. While the size of the device is not critical, it should be such as to be conveniently used with minimal chance of be entangled in the articles being washed. Moreover, the dispenser should have a loading capacity in the approximate range of 50 cc to 200 cc of laundry product.

Figure 6:
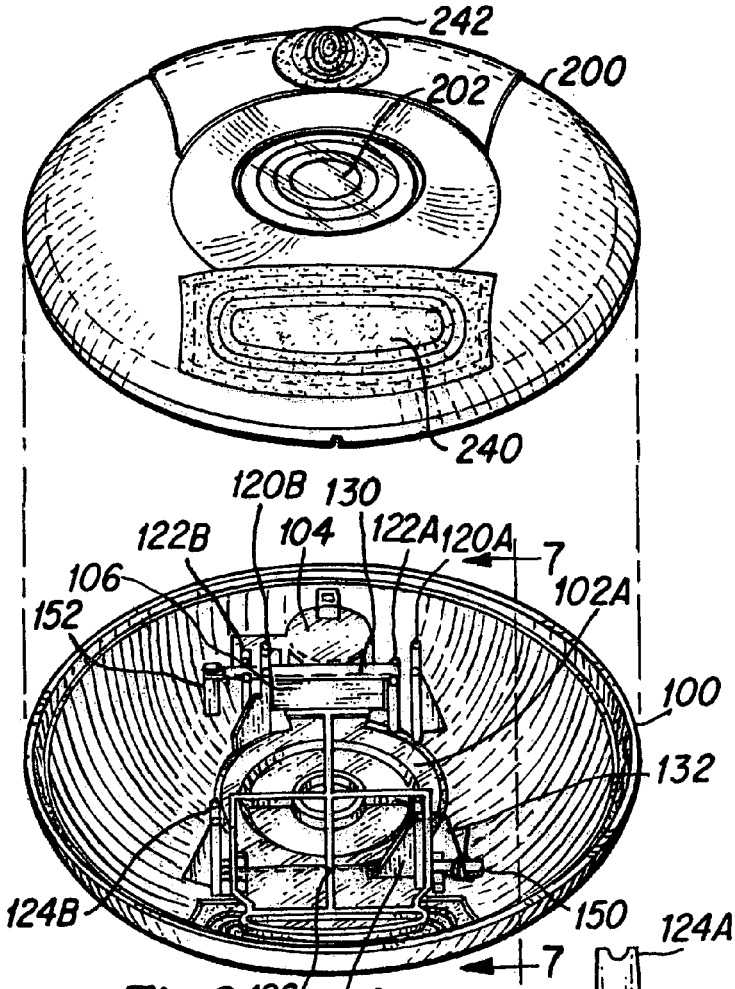
FIG. 6 is a perspective view of the interior of an embodiment of the dispenser.
Figure 7:
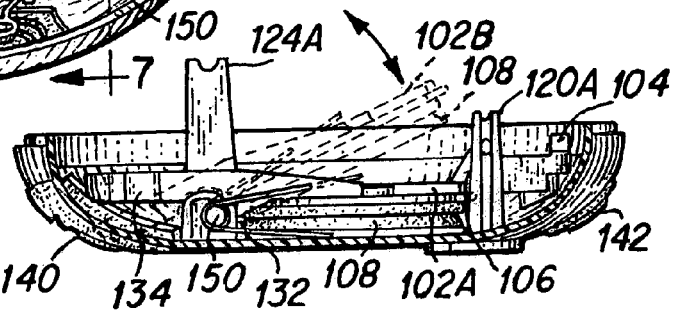
FIG. 7 is a cross-sectional view along line 7—7 of the dispenser shown in FIG. 6.

FIGS. 6 and 7 illustrate another embodiment of the dispenser that preferably has an overall disc-shaped configuration with a round perimeter and relatively flat outer contours formed on opposite sides. The dispenser is formed by preferably permanently attaching two halves or shells 100, 200; the internal features of shell 100 are depicted in the figures. Shell 100 defines an inner chamber having an aperture that is covered by closed hinged-door 102A, which is biased by spring 132 to swing toward the interior of the chamber to an opened position 102B as shown in FIG. 7. The outer surface of the door has an o-ring, water-resistant gasket 108 that keeps the interior chamber substantially isolated from the environment when the door is closed.

The door 102A has an extension 134 that extends toward an outer edge of the interior of the chamber. The door has a rotatable rod 150 on each side that permits the hinged door to readily move from a closed position 102A to an opened position 102B. Rib structure 126 provides structural support for the door 102A and extension 134 while minimizing the mass of the dispenser.

The dispenser further includes a lever/weight assembly that responds to centrifugal force to open the hinged door. The lever/weight assembly includes a weight 104 that is positioned near the outer edge of the chamber and an extension arm 106. The extension arm 106, which functions as a latch, engages the top surface of the hinged door 102A to keep it closed until the weight is subject to centrifugal force. In addition, as depicted in FIG. 6, a spring mechanism 152 that is cooperatively connected to rod 130 creates a spring load that biases the extension arm 106 so that when the door is pushed to its closed position, the door remains sealed until weight 104 encounters the requisite centrifugal force. As shown, the lever/weight assembly has a rotatable rod 130 that is supported by support posts 122A and 122B.

As further depicted, the dispenser also preferably includes support columns 124A, 124B and 120A and 120B that are strategically located to afford structural integrity to the dispenser. To assemble a dispenser, two shells, each of which has the support columns, are attached together. Preferably the two shells are assembled as mirror images of each other so that in the fabricated dispenser, both weights are on the same end of the chamber.

As shown in FIG. 7, certain parts of the dispenser's exterior notably portions 140 and 142 can be fabricated with a pliable water-resistant material. Portions on the exterior of shell 200, with closed door 202, that are denoted by reference numbers 240 and 242 correspond to portions 140 and 142 of shell 100, respectively. When the consumer presses portion 142 and engages weight 104, the extension arm 106 concomitantly is pressed away from the edge of door 102A. As a result, the hinged door springs from its closed position 102A to an open position 102B. The resilient gasket 108 around perimeter of door 102A provides some of the spring loading on the door, while spring 132 provides the majority of the spring loading.

In use, the consumer fills the chamber of the dispenser with laundry product through one of the opened doors. After the chamber is loaded with laundry product, the consumer closes the door by pressing into portion 140 and engaging extension 134 until the door is reengaged to extension arm 106. The gasket seals the interface between door 102A and the opening. The dispenser is then ready for use as described previously. During the spin cycle, the dispenser will orient itself so that one of the two flat surfaces is banked against the inner surface of the basket (or against clothing adhering to the inner surface). Centrifugal force will open the door that is facing the center of the basket but the contents will not be released until the spin cycle has substantially terminated.

Preferably, the dispenser should be made of materials that are resistant to the harsh physical and chemical conditions encountered in an automatic washing machine. Suitable materials include plastics that also afford buoyancy to the device. The materials should also be able to tolerate high temperatures in a drying machine in the event that the consumer neglects to remove the dispenser before loading the clothes into the dryer. Furthermore, the material can be transparent or part of the device can include a transparent window so that the consumer can see the amount of laundry product inside.

Household automatic washing machines typically have spin cycle speeds of between about 400 to 1000 rpm. Dispensers of the present invention are designed accordingly so that the biased-doors are actuated at the appropriate speeds. One of the benefits of using biased-doors is that the dispenser is more reliable and will consistently open during the spin cycle. With prior art dispensers such as those having an aperture that is sealed with a valve that is tethered to a movable weight, operation of the device can be adversely influenced by conditions in the washing machine. For instance, when the dispenser is fully loaded with a solid laundry product, the weight may not move far enough so that the aperture becomes only partially opened. Furthermore, when using prior art dispensers in some automatic washing machines, liquid products can be displaced by the movement of the weight or dissolved away by water seeping into the dispenser during the spin cycle resulting in a waste of product. With other devices, fluctuations in temperatures and/or pressure inside the dispenser chamber may cause the aperture to open prematurely or too late.

Although dispensers with two apertures are most preferred, it is contemplated that the inventive dispenser may have only a single aperture or may have a plurality of apertures. Dispensers with a single aperture can be designed so that the aperture will consistently face the interior of the washing machine basket during the spin cycle. This in turn will insure that the laundry product remains within the dispenser chamber until the spin cycle has terminated.

Referring to the lower portion of the dispenser as shown in FIGS. 5 and 6, for instance, a single aperture dispenser will be fabricated by simply enclosing this lower portion. This single aperture device can further include means for orienting the device while under the influence of centrifugal force within the washing machine basket. This may include making the portion of the dispenser that is opposite the aperture heavier since it is known that centrifugal force acting on an object will cause the object's heaviest side to be farthest from the center of rotation. In addition, the exterior surface of the portion of the dispenser that is opposite the aperture can be made flat whereas the dispenser's exterior surface, on the side where the aperture is located, is made convex-shaped. This configuration increases the likelihood that the dispenser's flat exterior surface will be oriented toward the basket wall during the spin cycle with the aperture facing the interior of the basket.

Dispensers with a plurality of apertures can also be fabricated. For example, dispensers can be manufactured having a polyhedron exterior configuration with multiple apertures. In the case of a tetrahedron, one or more of the four faces can each have an aperture and accompanying biased-door mechanism. If only three of the faces have apertures, then the dispenser can be made so the surface or face without the aperture will become oriented toward the basket wall during the spin cycle. This can be achieved by appropriate distribution of weight and/or making the exterior surface of the faces with the aperture more convex-like.

While described in terms of the presently preferred embodiments, it is to be understood that such disclosure is not to be interpreted as limiting. Various modifications and alterations will no doubt occur to one skilled in the art after having read the above disclosure. Accordingly, it is intended that the appended claims be interpreted as covering all alterations and modifications as fall within the true spirit and scope of the invention.

What is claimed is:

1. A dispenser, for use in a basket of an automatic washing machine for dispersing a laundry product into the basket that includes a rotatable inner wall and an interior region, wherein the dispenser comprises:

a housing defining an internal chamber adapted to receive the laundry product and having at least one aperture;

cover means for covering and sealing the at least one aperture wherein the cover means includes at least one cover that is movable between a closed position and an opened position upon activation of the cover means;

latch means for engaging the at least one cover to maintain the at least one cover in its closed position until the latch means is disengaged whereby the at least one cover moves to its opened position;

a weight assembly that is actuated by centrifugal force and that is operatively connected to the latch means, whereby the weight assembly upon actuation by the centrifugal force causes the latch means to disengage the at least one cover;

means for causing the housing to orient within the basket, when the housing is subject to a centrifugal force, so that when the weight assembly is actuated and the at least one cover moves to its opened position the laundry product remains within the internal chamber until the centrifugal force has substantially subsided or been removed, with the proviso that only one aperture becomes exposed to the environment when the housing is subject to the centrifugal force; and means for biasing the weight assembly to return the weight assembly to a neutral position when the centrifugal force has substantially subsided or been removed.

2. The dispenser of claim 1 wherein the weight assembly is spring loaded to return the weight assembly to a neutral position when the centrifugal force has substantially subsided or been removed.

3. The dispenser of claim 1 wherein the housing has a non-spherical outer configuration that defines at least one alignment surface that is oriented toward the inner rotatable wall of the basket when the housing is subject to the centrifugal force.

4. The dispenser of claim 1 wherein the housing has a disc-shaped outer configuration having two alignment surfaces which are located at substantially opposing sides of the housing.

5. The dispenser of claim 4 wherein the housing has a first aperture located on a first alignment surface and a second aperture located on a second alignment surface.

6. The dispenser of claim 1 wherein the weight assembly includes at least one counterweight that is actuated by the centrifugal force.

7. The dispenser of claim 1 wherein each aperture has a corresponding cover.

8. The dispenser of claim 1 wherein the housing has a first aperture with an associated first cover and a second aperture with an associated second cover and wherein each cover is biased to move to its opened position and characterized in that the first and second covers are maintained in their closed positions by the latch means until the latch means is disengaged.

9. The dispenser of claim 8 wherein the first cover is engaged by a first latch means that is cooperatively connected to a first counterweight that is actuated by the centrifugal force and the second cover is engaged by a second latch means that is cooperatively connected to a second counterweight that is actuated by the centrifugal force with the proviso that only one cover is opened when the dispenser is subject to centrifugal force.

10. The dispenser of claim 8 wherein each cover comprises a biased door.

11. The dispenser of claim 1 wherein the dispenser is buoyant in water.

12. The dispenser of claim 1 wherein at least part of the housing is made of transparent material.

13. A method of dispensing a laundry product into an automatic washing machine that is equipped with a basket having a rotatable inner wall and an interior region so that the laundry product is released from the dispenser following the spin cycle, said method comprising the steps of:

(a) providing a dispenser that comprises:

(i) a housing defining an internal chamber adapted to receive the laundry product and having at least one aperture;

(ii) cover means for covering and sealing the at least one aperture wherein the cover means includes at least one cover that is movable between a closed position and an opened position upon activation of the cover means;

(iii) latch means for engaging the at least one cover to maintain the at least one cover in its closed position until the latch means is disengaged whereby the at least one cover moves to its opened position;

(iv) a weight assembly that is actuated by centrifugal force and that is operatively connected to the latch means, whereby the weight assembly upon actuation by the centrifugal force causes the latch means to disengage the at least one cover;

(v) means for causing the housing to orient within the basket, when the housing is subject to a centrifugal force, so that when the weight assembly is actuated and the at least one cover moves to its opened position the laundry product remains within the internal chamber until the centrifugal force has substantially subsided or been removed, with the proviso that only one aperture becomes exposed to the environment when the housing is subject to the centrifugal force; and (vi) means for biasing the weight assembly to return the weight assembly to a neutral position when the centrifugal force has substantially subsided or been removed;

(b) filling the internal chamber of the dispenser with a laundry product and closing the at least one aperture;

(c) placing the dispenser into the basket of the washing machine along with articles of clothing; and (d) operating the washing machine whereby during the spin cycle one of the apertures open but the laundry product remains within the chamber until the spin cycle has stopped and water begins to fill the basket whereupon the laundry product dissolves or otherwise mixes into the water.

14. The method of claim 13 wherein the weight assembly is spring loaded to return the weight assembly to a neutral position when the centrifugal force has substantially subsided or been removed.

15. The method of claim 13 wherein the housing has a non-spherical outer configuration that defines at least one alignment surface that is oriented toward the inner rotatable wall of the basket when the housing is subject to the centrifugal force.

16. The method of claim 13 wherein the housing has a disc-shaped outer configuration having two alignment surfaces which are located at substantially opposing sides of the housing.

17. The method of claim 16 wherein the housing has a first aperture located on a first alignment surface and a second aperture located on a second alignment surface.

18. The method of claim 13 wherein the weight assembly includes at least one counterweight that is actuated by the centrifugal force.

19. The method of claim 13 wherein each aperture has a corresponding cover.

20. The method of claim 13 wherein the housing has a first aperture with an associated first cover and a second aperture with an associated second cover and wherein each cover is biased to move to its opened position and characterized in that the first and second covers are maintained in their closed positions by the latch means until the latch means is disengaged.

21. The method of claim 20 wherein the first cover is engaged by a first latch means that is cooperatively connected to a first counterweight that is actuated by the centrifugal force and the second cover is engaged by a second latch means that is cooperatively connected to a second counterweight that is actuated by the centrifugal force with the proviso that only one cover is opened when the dispenser is subject to centrifugal force.

22. The method of claim 20 wherein each cover comprises a biased door.

23. The method of claim 13 wherein the dispenser is buoyant in water.

24. The method of claim 13 wherein at least part of the housing is made of transparent material.

* * * * *